United States Patent [19]

Dimino

[11] Patent Number: 4,460,221

[45] Date of Patent: Jul. 17, 1984

[54] WINE BAR

[76] Inventor: William Dimino, 12226 ½ Montana Ave., Los Angeles, Calif. 90049

[21] Appl. No.: 295,593

[22] Filed: Aug. 24, 1981

[51] Int. Cl.[3] ..... E21B 46/00

[52] U.S. Cl. ..... 312/277; 312/281; 312/317 R

[58] Field of Search ..... 312/277, 281, 317 R; 211/71, 74; 108/25; 248/240.4

[56] References Cited

U.S. PATENT DOCUMENTS

| | | | |
|---|---|---|---|
| 1,179,017 | 4/1916 | McVicker | 312/317 R X |
| 2,975,906 | 3/1961 | Van Der Togt | 211/74 |
| 3,022,899 | 2/1962 | Unsworth | 211/71 |
| 3,463,436 | 8/1969 | Foster, Jr. | 211/71 X |
| 4,008,810 | 2/1977 | Merz | 211/71 |
| 4,122,780 | 10/1978 | Brickman | 108/25 |
| 4,228,905 | 10/1980 | Cammarota | 211/71 |

FOREIGN PATENT DOCUMENTS

| | | | |
|---|---|---|---|
| 815236 | 8/1951 | Fed. Rep. of Germany | 108/25 |
| 1193216 | 5/1965 | Fed. Rep. of Germany . | |
| 1518172 | 7/1978 | United Kingdom | 108/25 |

*Primary Examiner*—William E. Lyddane
*Assistant Examiner*—Joseph Falk
*Attorney, Agent, or Firm*—W. Edward Johansen

[57] ABSTRACT

The present invention is a wine bar for storing wine bottles and wine glasses which includes a section of a wine barrel having a closed end and an open end. The wine bar also includes a plurality of rack forming elements each of which is disposed in the lower half of the section of the wine barrel and on which the wine bottles are stored and a plurality of brackets each of which has a pair of flanges to which inwardly opening outwardly offset channels are connected in order to store the wine glasses thereon. The wine bar further includes a cylindrical member, which is formed out of an insulating material and which has a bottom, and supporting device for supporting the cylindrical member whereby one of the wine bottles may be placed in the cylindrical member. The supporting device is mechanically coupled to the section of the wine barrel. A first semicircular member which is disposed adjacent to the top half of the open end of the section of the wine barrel and which is pivotally coupled to the side of the section of the wine barrel along its straight edge of its diameter so that the first semicircular member may open or enclose the top half of the section of the wine barrel and two halves of a second semicircular member which are disposed adjacent to the bottom half of the open end of the section of the wine barrel encloses the open end of the section of the wine barrel. The two halves of the second semicircular member are pivotally coupled to the support member so that they not only open and close the bottom half of the section of the wine barrel, but also support the first semicircular member in its open position.

1 Claim, 5 Drawing Figures

Fig. 1.
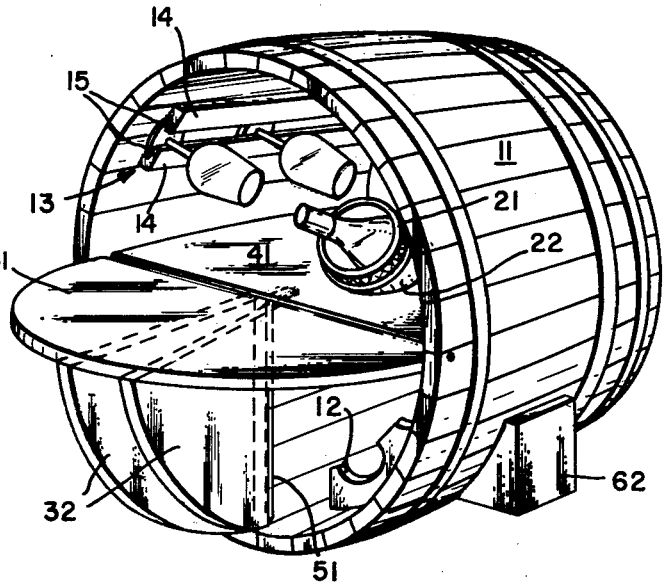
Fig. 2.
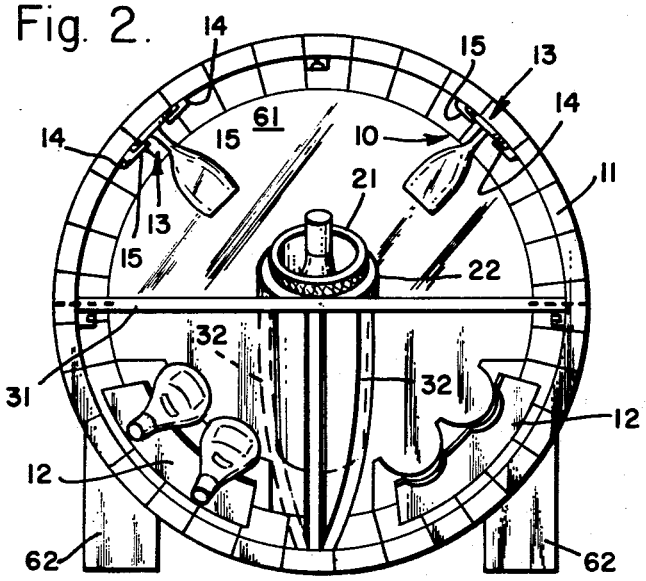
Fig. 4.
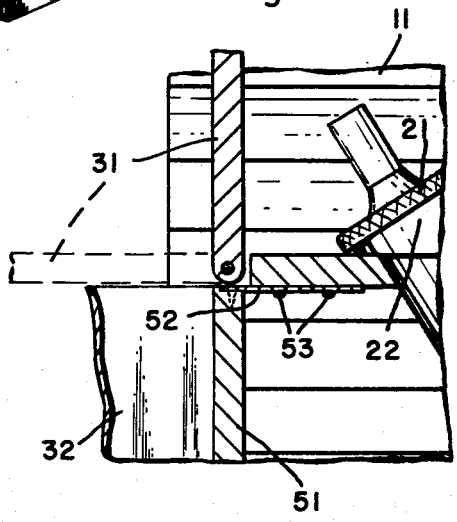
Fig. 3.
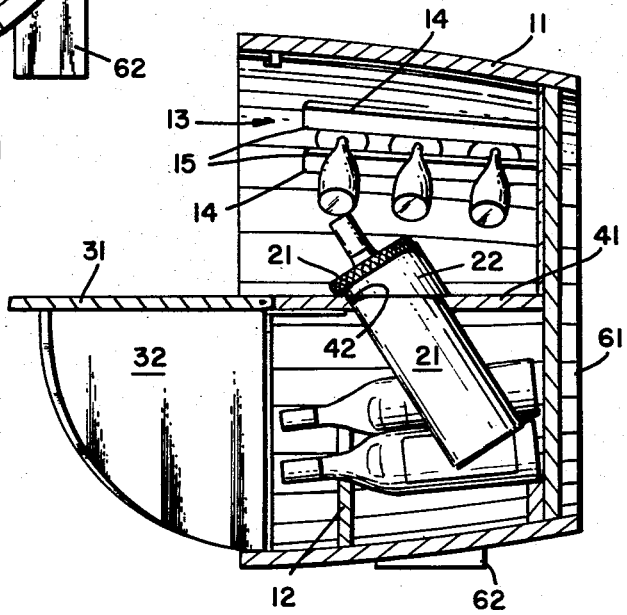
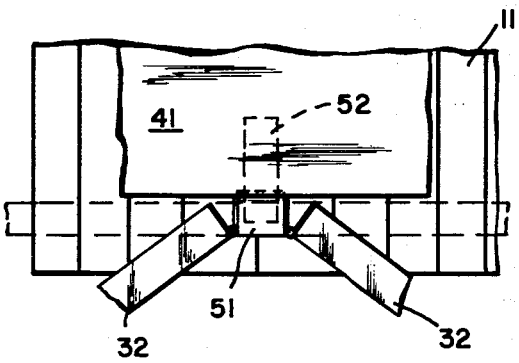
Fig. 5.

WINE BAR

BACKGROUND OF THE INVENTION

1. Field of the Invention

The present invention relates to a wine rack and more particularly to a wine rack which not only holds a plurality of bottles of wine, but which also displays them uniquely.

2. Description of the Prior Art

U.S. Pat. No. Des. 256,640, entitled Wine Rack, issued to Gardner W. Farwell and George A. Bernard on Sept. 2, 1980, and U.S. Pat. No. Des. 253,802, entitled Wine Rack, issued to Barry H. Loud and Eileen M. Redmon on Jan. 1, 1980, both teach designs for a wine rack.

U.S. Pat. No. 4,093,076, entitled Bottle Racks, Particularly Racks for Wine Bottles, issued to Brian R. Newton on June 6, 1978, teaches a rack for bottles, or the like, which includes a plurality of basic rack forming elements arranged in two spaced apart substantially coplanar sets; each of said basic elements having a periphery defined by edges; at least one concave formation defined in a said edge, thereby to define at least part of a supporting surface for a bottle, or the like; said basic elements of said sets thereof are oriented and positioned such that each concave formation defined in the basic elements making up one of said sets is generally aligned with a concave formation defined in the basic elements making up the other of said sets, thereby to provide and define at least part of two cooperating supporting surfaces for support of a bottle, or the like, that extends between two aligned said formations on the two said sets; means for joining said sets of basic elements and for supporting them in their said orientations; the edges of the outermost basic elements of each set defining the free edge portions of the sets said free edge portions being aligned; a terminal rack forming element extending between said sets at a free edge portion thereof; said terminal element being in engagement with a said aligned free edge portion of both said sets; thereby closing off said free edge portion of both said sets and to close off the space between said sets.

U.S. Pat. No. 4,182,455, entitled Container Rack, issued to Adam Zurawin on Jan. 8, 1980, teaches a hollowmolded rack which is used for displaying and dispensing containers. The rack can be wall mounted alone or in close alignment with other like racks. The rack is especially suitable for mounting a collection of empty or full beverage food and parts holding cans.

U.S. Pat. No. 4,228,905, entitled Stemware Shelf Bracket, issued to David F. Cammarota on Oct. 21, 1980, teaches a bracket which has a flat rack which is provided with upstanding front and rear flanges to which inwardly opening outwardly offset channels are connected. The bracket is slipped longitundinally on the underside of a removable shelf, so that the front and rear edge portions of the shelf are engaged thereby. Longitudinal openings for inverted stemware bases are provided in the front flange, with rearwardly extending slots for the stems thereof in communication with the centers of such openings. When such shelf is repositioned, the rack is located directly thereunder with the front and rear flanges offset inwardly of the front and rear edges of the shelf to insure stability of the bracket on the shelf. Thus, inverted stemware can be hung thereon by simple passing the bases through the opening and the stems into the corresponding slots.

SUMMARY OF THE INVENTION

In view of the foregoing factors and conditions which are characteristic of the prior art it is the primary object of the present invention to provide wine bar which stores not only wine bottles and wine glasses, but which also functions a bar for serving glasses of wine.

In accordance with the present invention an embodiment of a wine bar for storing wine bottles and wine glasses is disclosed. The wine bar includes a section of a wine barrel having a closed end and an open end. The wine bar also includes a plurality of rack forming elements each of which is disposed in the lower half of the section of the wine barrel and on which the wine bottles are stored and a plurality of brackets each of which has a pair of flanges to which inwardly opening outwardly offset channels are connected in order to store the wine glasses thereon. The wine bar further includes a cylindrical member, which is formed out of an insulating material and which has a bottom, and supporting device for supporting the cylindrical member whereby one of the wine bottles may be placed in the cylindrical member. The supporting device is mechanically coupled to the section of the wine barrel. A first semicircular member which is disposed adjacent to the top half of the open end of the section of the wine barrel and which is pivotally coupled to the side of the section of the wine barrel along its straight edge of its diameter so that the first semicircular member may open or enclose the top half of the section of the wine barrel and two halves of a second semicircular member which are disposed adjacent to the bottom half of the open end of the section of the wine barrel encloses the open end of the section of the wine barrel. The two halves of the second semicircular member are pivotally coupled to the support member so that they not only open and close the bottom half of the section of the wine barrel, but also support the first semicircular member in its open position.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a wine bar which has been constructed in accordance with the principles of the present invention.

FIG. 2 is a front elevational view of the wine bar of FIG. 1.

FIG. 3 is a side elevational, cross-sectional view of the wine bar of FIG. 1.

FIG. 4 is an enlarged fragmentary view of the side elevational, cross-sectional view of the wine bar of FIG. 1.

FIG. 5 is a partial top plan view of the wine bar of FIG. 1.

DESCRIPTION OF THE PREFERRED EMBODIMENT

In order to best understand the present invention it is necessary to refer to the following description of its preferred embodiment in conjunction with accompanying drawing. Referring to FIG. 1 a wine bar 10 for storing wine bottles and wine glasses includes a section of a wine barrel The wine bar 11 also includes a plurality of rack forming elements 12 each of which is disposed in the lower half of the section of the wine barrel 11 and on which the wine bottles are stored and a plurality of brackets 13 each of which has a pair of flanges 14 to which inwardly opening outwardly offset channels 15 are connected in order to store the wine glasses thereon. Each of the plurality of bracket is similar to the bracket which U.S. Pat. No. 4,228,905 teaches.

Referring to FIG. 2 in conjunction with FIG. 3 the wine bar 10 further includes a cylindrical member 21 which is formed out of an insulating material and which has a bottom and a supporting device 22 for supporting the cylindrical member 21 whereby one of the wine bottles may be placed in the cylindrical member 21. The supporting device 22 is mechanically coupled to the section of the wine barrel 11.

Referring to FIG. 3 in conjunction with FIG. 1 and FIG. 2 the wine bar 10 has a first semicircular member 31 which is disposed adjacent to the top half of the open end of the section of the wine barrel 11 and which is pivotally coupled to the side of the section of the wine barrel 11 by an axle along its straight peripheral edge edge so that the first semicircular member 31 may open or close the top half of the section of the wine barrel 11. The wine bar 10 also has two halves of a second semicircular member 32 which are disposed adjacent to the bottom half of the open end of the section of the wine barrel 11.

Referring to FIG. 4 in conjunction with FIG. 1 and FIG. 3 the wine bar 11 further has a flat member 41 which is fitted inside the section of the wine barrel 11 so that the flat surface of the flat member 11 is aligned with the flat surface of the first semicircular member 31 when the first semicircular member 31 is in its open position with the flat member 41 having a hole 42 and the supporting member 22 which is disposed within the hole 42 in the flat member 41 and in which the cylindrical member 21 is mounted.

Referring to FIG. 5 in conjunction with FIG. 4 the two halves of the second semicircular member 32 are centrally and pivotally coupled to a support member 51. The support member 51 is mechanically coupled to the section of the wine barrel 11 and is disposed adjacent to the bottom half of the open end of the section of the wine barrel 11 and perpendicular to the axle so that the two half-portions of the second semicircular member 32 may not only open and close the bottom half of the section of the wine barrel 11, but may also support the first semicircular member 31 in its open position. The support member 51 is mechanically coupled to the bottom half of the section of the wine barrel 11 and to the flat member 41 by a bracket 52 wherein a pair of coupling devices 53 are mechanically coupled to the support member 51.

Referring still to FIG. 5 in conjunction with FIG. 4 the first semicircular member 31 is pivotally coupled to the sides of the section of the wine barrel 11 and is supported in its open position by the two halves of the second semicircular member 32 which are pivotally coupled to the support member 51 so that they may rotate outwardly underneath the first semicircular member 31 in order to support it.

Referring again to FIG. 2 a mirror 61 may be added to enhance the appearance of the wine bar 10. Similarly, the first and second semicircular members 31 and 32 may have a design incorporated on their exposed surface. The section of the wine barrel 11 is supported on a pair of mounting support members 62. The cylindrical member 22, which in the preferred embodiment is formed out of clay, may be formed out of any insulating material and is used to maintain a wine bottle at an appropriate temperature.

From the foregoing it can be seen that a wine bar has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A wine bar for storing wine bottles and wine glasses comprising:

a. a section of a wine barrel having a closed end and an open end;

b. a plurality of rack forming elements each of which is disposed in the lower half of said section of said wine barrel and on which the wine bottles are stored;

c. a plurality of brackets each of which has a pair of flanges to which inwardly opening outwardly offset channels are connected in order to store the wine glasses thereon;

d. a cylindrical member which is formed out of an insulating material and which has a bottom;

e. a first semicircular member which is disposed adjacent to the top half of said open end of said section of said wine barrel and which is pivotally coupled by an axle to the side of said section of said wine barrel along its straight peripheral edge so that said first semicircular member either opens or closes the top half of said section of said wine barrel;

f. a second semicircular member which is divided into two half-portions and which is disposed adjacent to the bottom half of said open end of said section of said wine barrel;

g. a support member which is mechanically coupled to said section of said wine barrel and which is disposed adjacent to the bottom half of said open end of said section of said wine barrel and perpendicular to said axle;

h. a flat member which is fitted inside said section of said wine barrel so that the flat surface of said flat member is aligned with the flat surface of said first semicircular member when said first semicircular member is in its open position with said flat member having a hole;

i. coupling means for pivotally coupling said two half-portions of said second semicircular member to said support member so said two half-portions of said second semicircular member not only open and close the bottom half of said section of said wine barrel, but also support in conjunction with each other said first semicircular member in its open position; and j. a mounting member which is disposed within said hole in said flat member and on which said cylindrical member is mounted wherein said support member is mechanically coupled to the bottom half of said section of said wine barrel and to said flat member by a bracket and wherein said coupling means is mechanically coupled to said support member in order to support said cylindrical member whereby one of the wine bottles may be placed in said cylindrical member.

* * * * *